United States Patent [19]

Konosu

[11] 4,415,831

[45] Nov. 15, 1983

[54] ELECTROMAGNETIC DEFLECTION TYPE PICTURE TUBE DEVICE

[75] Inventor: Osamu Konosu, Nagaokakyo, Japan

[73] Assignee: Matsushita Electronics Corporation, Tokyo, Japan

[21] Appl. No.: 288,052

[22] Filed: Jul. 29, 1981

[30] Foreign Application Priority Data

Aug. 19, 1980 [JP] Japan ..... 55-114501

[51] Int. Cl.[3] ..... H01J 29/76

[52] U.S. Cl. ..... 313/413; 313/431; 313/440

[58] Field of Search ..... 313/413, 414, 440, 431, 313/412

[56] References Cited

U.S. PATENT DOCUMENTS 4,330,709 5/1982 Chambost ..... 313/431 X 4,346,327 8/1982 Barten ..... 313/413

*Primary Examiner*—Palmer C. Demeo

*Attorney, Agent, or Firm*—Burgess, Ryan & Wayne

[57] ABSTRACT

An electromagnetic deflection type picture tube has (a) a first field-control element which is disposed between the electron-beam emission end of an electron gun and a deflection yoke, comprising a pair of magnetic pieces disposed on the opposite sides of the path of an electron beam and being adapted to produce or introduce a barrel- or pincushion-like local field distortion which is opposite to a pincushion- or barrel-like deflection field distortion produced by the deflection yoke by introducing the rise portion of the deflection field; and (b) a second field-control element which is disposed between the electron-beam emission end of the electron gun and the first field-control element, comprising a pair of magnetic pieces disposed on the opposite sides of the path of the electron beam and being adapted to produce or introduce a pincushion- or barrel-like local field distortion which is opposite to the barrel- or pincushion-like local field distortion produced by the first field-control element. A positive or negative comma aberration imparted to the electron beam by the second field-control element is compensated for by a negative or positive comma aberration imparted to the electron beam by the first field-control element so that on leaving the latter, the electron beam sustains only an astigmatism, positive or negative, which is compensated for or corrected by an astigmatism, negative or positive, imparted to the electron beam passing through the deflection field. Thus, distortions of beam spots at the edges of a screen can be substantially eliminated.

2 Claims, 15 Drawing Figures

ELECTROMAGNETIC DEFLECTION TYPE PICTURE TUBE DEVICE

BACKGROUND OF THE INVENTION

The present invention relates to an electromagnetic deflection type picture tube device which ensures better resolution over the whole surface of a screen.

In general, picture tubes like television picture tubes which reproduce relatively large images have a wide screen and a wide deflection angle of electron beam, so that the electromagnetic deflection system of high deflection efficiency is employed. In order to reduce distortions of images to a minimum or in order to attain a higher degree of convergence of three electron beams over a screen, the deflection field is suitably distorted that is, the distribution of a deflection field is varied. For instance, in the case of the in-line self-convergence type color picture tube, the horizontal deflection field is imparted with a strong pincushion distortion while the vertical deflection field, with a strong barrel distortion so that the three electron beams are correctly converged especially at the edges of a screen.

However, the prior art in-line self-convergence systems are all not satisfactory in their performance in practice that is, they cannot attain a satisfactory degree of resolution.

SUMMARY OF THE INVENTION

The primary object of the present invention is, therefore, to attain a higher degree of resolution of three electron beams at the edges of a screen in an in-line self-convergence type color picture tube.

The present invention provides an electromagnetic deflection type picture tube device having (a) a first field-control element which is disposed between the electron-beam emission end of an electron gun and a deflection yoke, comprising a pair of semi-cylindrical magnetic pieces disposed on the opposite sides of the path of an electron beam and being adapted to produce or introduce a pincushion- or barrel-like local field distortion which is opposite to a barrel- or pincushion-like field distortion introduced by the deflection yoke by introducing the rise portion of the deflection field; and (b) a second field-control element which is disposed between the electron gun and the first field-control element, comprising a pair of semi-cylindrical magnetic pieces disposed on the opposite sides of the path of the electron beam and being adapted to produce or introduce a barrel- or pincushion-like local field distortion which is opposite to the barrel- or pincushion-like local field distortion introduced by the first field-control element. The second field-control element imparts the electron beam a comma aberration, positive or negative, which in turn is compensated for or corrected by a comma aberration, negative or positive, imparted by the first field-control element. As a consequence, on leaving the first field-control element, the electron beam sustains only an astigmatism, positive or negative, which in turn is compensated for or corrected by an astigmatism, negative or positive, imparted by the distorted deflection field. As a result, the distortions of beam spots at the edges of a screen can be reduced to a minimum or substantially eliminated.

The above and other objects, effects and features of the present invention will become more apparent from the following description of preferred embodiments of the present invention taken in conjunction with the accompanying drawings.

DETAILED DESCRIPTION OF THE PRIOR ART

Figure 1:
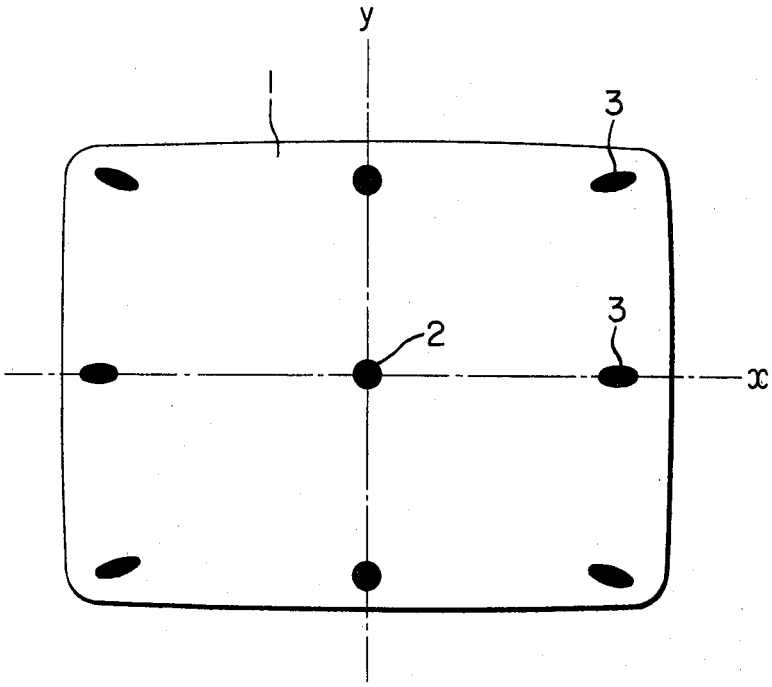
FIG. 1 is a top view of the screen of a self-convergence, electromagnetic deflection type picture tube, illustrating distortions of beam spots.

In the in-life self-convergence type color picture tube device, strong pincushion distortions introduced into the horizontal deflection field and barrel distortions introduced into the vertical deflection field cause distortions of beam spots produced over a screen 1 by electrons beams focused at the screen 1. That is, even through a beam spot 2 of a true circle is obtained at the center of the screen 1, the beam spots 3 are elongated in the horizontal or lateral direction as shown in FIG. 1.

Figure 2A:
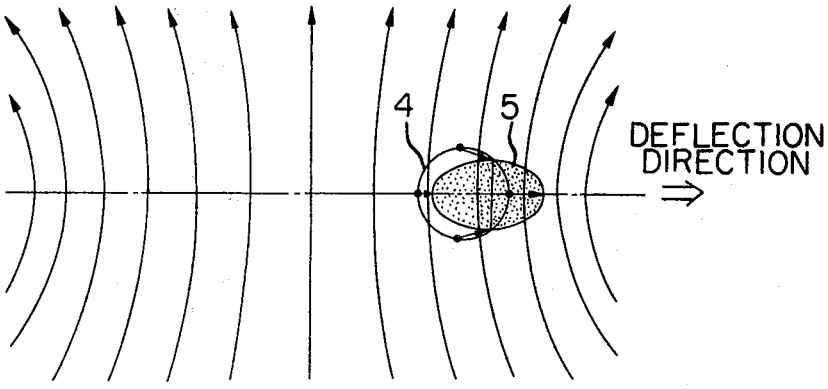
FIGS. 2A and 2B are views used for the explanation of the action of a distorted magnetic field of an electron beam being deflected.
Figure 2B:
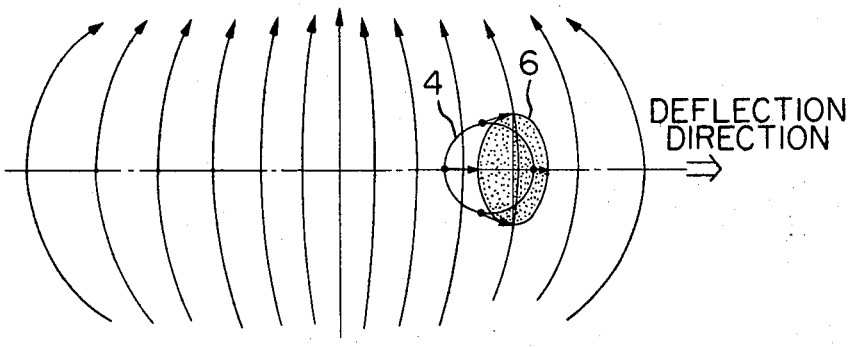

Referring to FIGS. 2A and 2B, the reasons causing such distortions of the beam spots 3 will be described. Under the pincushion-like-distorted deflection field as shown in FIG. 2A, the cross section of an electron beam 4 is elongated in the direction of deflection due to the positive astigmatism. In like manner, under the barrel-like-distorted deflection field as shown in FIG. 2B, the cross section of the electron beam 4 is elongated in the direction perpendicular to the direction of deflection due to the negative astigmatism. As a result, the electron beam 4 which passes the pincushion-like-distorted deflection field as shown in FIG. 2A produces an elliptical spot of light 5 elongated in the direction of deflection while the electron beam which passes the barrel-like-distorted deflection field produces an elliptical spot of light 6 elongated in the direction of perpendicular to the direction of deflection.

Such distortions of beam spots due to the distorted deflection fields can be corrected to some extent by the conventional technique. For instance, according to the method disclosed in Japanese Laid Open Patent Application No. 123869/1979, a field-control element comprising a pair of cylindrical magnetic elements or pieces is disposed at the electron-beam emission end of each electron gun so that the rise portion of the deflection field is directed toward the field-control element. The field-control element is adapted to produce a strong local magnetic field which is so distorted as to compensate for a distortion of the deflection field. That is, for the pincushion- or barrel-like-distorted deflection field, a barrel- or pincushion-like-distorted local magnetic field is produced. As a result, prior to passing through the pincushion-like-distorted or barrel-like-distorted deflection field, the electron beam is subjected to the opposite distortion that is, a barrel- or pincushion-like-distorted local magnetic field. To put in another way, the field-control element exerts the magnetic field for cmpensating for astigmatism to the electron beam entering the distorted deflection field.

Figure 3A:
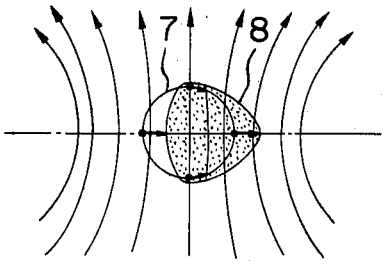
FIGS. 3A and 3B are views used for the explanation of the action of a distorted magnetic field on an electron beam which is not deflected.
Figure 3B:
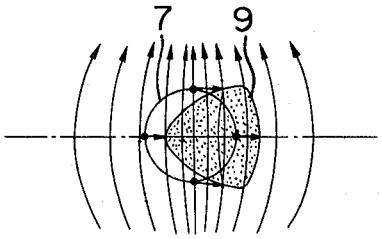

However, as shown in FIGS. 3A and 3B, the influence of the deflection field upon the electron beam at the electron-beam emission end of the electron gun is weak, so that the electron beam is coaxial with the electron gun as indicated by 7. However, under the influence of a plane-symmetrically distorted local magnetic field produced by the field-control element, the electron beam 7 is subjected to the common aberration as indicated by 8 or 9. As a consequence, it is impossible that such comma aberration be satisfactorily compensated for or corrected while the electron beam passes through the deflection field. In practice, it is more likely that the comma aberration be superimposed on the astigmatic distortion caused when the electron beam passes through the deflection field so that the cross section of the beam spot is distorted into a very complex form. As a result, a sufficiently higher degree of resolution cannot be obtained at the edges of the screen 1.

DESCRIPTION OF THE PREFERRED EMBODIMENTS

Figure 4:
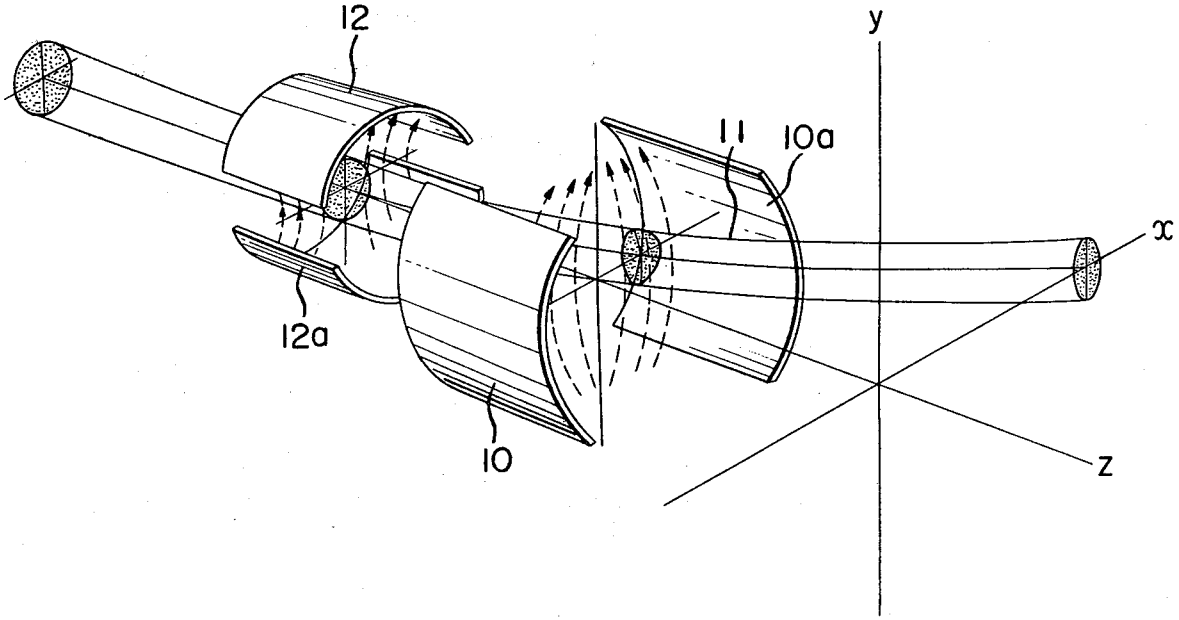
FIG. 4 is a perspective view of a first embodiment of the present invention.
Figure 5A:
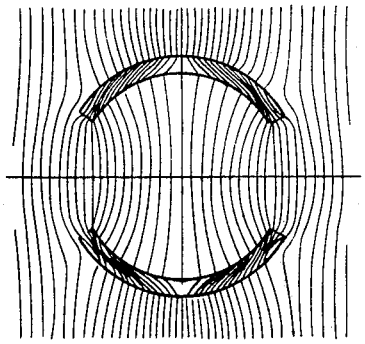
FIGS. 5A to 5D are views showing magnetic pieces in accordance with the present invention and horizontal deflection fields distorted thereby.
Figure 5B:
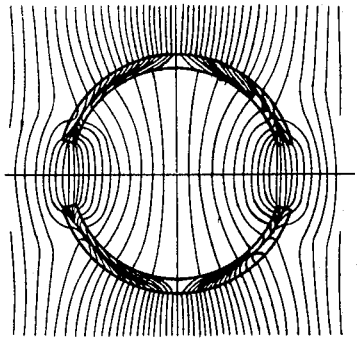
Figure 5C:
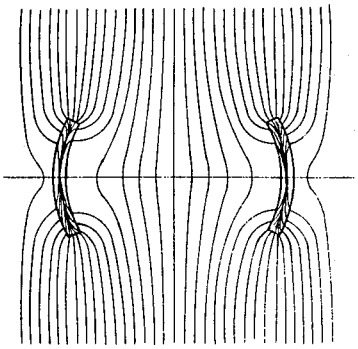
Figure 5D:
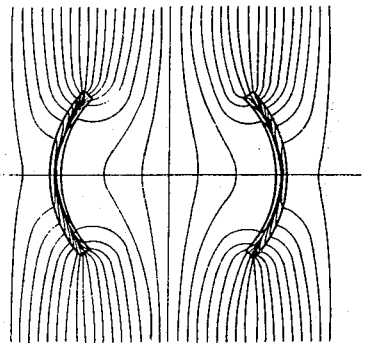
Figure 6A:
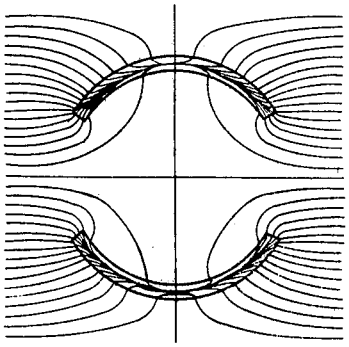
FIGS. 6A to 6D are views showing magnetic pieces in accordance with the present invention and vertical deflection fields distorted thereby.
Figure 6B:
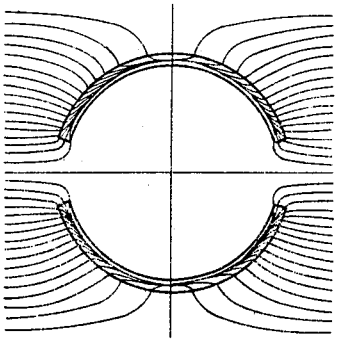
Figure 6C:
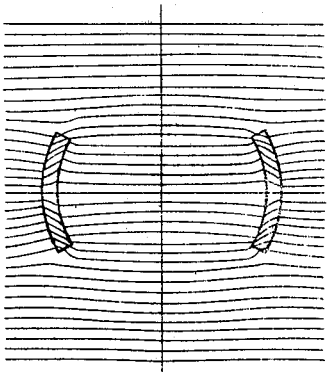
Figure 6D:
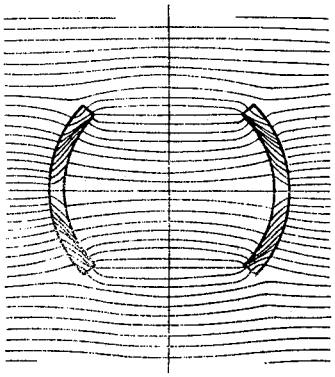

Referring next to FIG. 4, a first embodiment of the present invention will be described in detail below in conjunction with a pincushion-like-distorted deflection field. A first field-control element comprising a pair of semi-cylindrical magnetic pieces 10 and **10*a* acts on the rise portion of a deflection field so as to produce a barrel-like-distorted local magnetic field. To this end, the magnetic pieces 10 and 10*a* are disposed on the opposite sides, respectively, of the vertical or Y-axis at the rise position of the deflection field, that is, the position at which the electron beam is not yet subjected to the deflection field. When the electron beam 11 passes between the magnetic pieces 10 and 10*a*, it is subjected to an astigmatic distortion which is opposite to or complementary of an astigmatic distortion to which is subjected the electron beam 11 when it passes through the deflection field. That is, in this embodiment the electron beam 11 is subjected to a barrel-like astigmatic distortion which is opposite to or complementary of a pincushion distortion to which is subjected the electron beam 11** when it passes through the deflection field.

Disposed between the first field-control element and the emission end of an electron gun is a second field-control element comprising a pair of semi-cylindrical magnetic pieces 12 and **12*a* disposed symmetrically of the horizontal or X-axis. The second field-control element is adapted to produce a strong pincushion-like-distorted local magnetic field and passes therethrough the electron beam 11 which has almost not been deflected yet. The second field-control element serves to increase the length through the first field-control element along which the electron beam 11 experiences the deflection field. Furthermore, the second field-control element is adapted to cause a positive or negative comma aberration of the electron beam 11 when the latter is subjected to a negative or positive comma aberration when it passes through the first field-control element. As a result, the electron beam 11 emerging from the first field-control element is free from comma aberration, but is subjected to or sustains a barrel-like-distortion which can compensate for or correct a pincushion-like-distortion of the electron beam 11** caused when the latter passes through the deflection field.

It is assumed that the electron beam which is not subjected to the deflection field pass along the Z-axis and the X- and Y-axes are perpendicular to the Z-axis and to each other. Then, the magnetic field $\vec{H}$ which is symmetrical with respect to both the y-z and x-z planes is given by $$\vec{H} = \vec{H}_1(z) + \vec{H}_3(z)\cdot\vec{a}^2 + \vec{H}_5(z)\cdot\vec{a}^4 + \ldots \quad (1)$$

$$= \sum_{n=1}^{\infty} \vec{H}_{(2n-1)}\cdot\vec{a}^{2(n-1)}\ldots$$

where $a = x - jy$ and $$H = H_x + jH_y$$

That is, the magnetic field $\vec{H}$ is expressed in terms of the sum of fields with the number m of poles, where $m = 2(2n-1)$ where $n$ = integers In the vicinity of the Z-axis, Eq. (1) may be approximated by $$\vec{H} \approx \vec{H}_1(z) + \vec{H}_3(z)\cdot\vec{a}^2 \quad (2)$$

The magnetic field strength of the electron beam of a radius of r which acts on the electron in the edges of the electron beam when the latter passes the point $z_1$ on the Z-axis is given by $$\vec{H} \approx \vec{H}_1(z_1) + \vec{H}_3(z_1)\cdot\vec{r}^2 \quad (3)$$

The first term $\vec{H}_1(z_1)$ of Eq. (3) shows the deflection which the electron beam experiences in the uniform field $\vec{H}_1(z)$ and the second term $H_3(z_1)\cdot r^2$ shows the comma aberration which is proportional to the square of the distance from the Z-axis. Thus, Eq. (3) means that the beam spot has only a comma aberration.

In like manner, the field strength H acting on the electron beam which has been deflected (by a distance a) and passes at a point $z_2$ is given by $$\vec{H} = \vec{H}_1(z_2) + \vec{H}_3(z_2)\cdot(\vec{a} + \vec{r})^2 \quad (4)$$

$$= \vec{H}_1(z_2) + \vec{H}_3(z_2)\cdot\vec{a}^2 + 2\vec{H}_3(z_2)\cdot\vec{a}\cdot\vec{r} + \vec{H}_3(z_2)\cdot\vec{r}^2$$

The uniform field strength (that is, the deflection component) is the sum of the first and second terms. The fourth term shows a comma aberration and the third term shows an astigmatism which is proportional to the radius of the cross section of the electron beam.

According to the present invention, in Eqs. (3) and (4), let $$\vec{H}_3(z_1) = -\vec{H}_3(z_2) \quad (5)$$

As a result, a positive or negative comma aberration is compensated for or corrected by a negative or positive comma aberration so that the electron beams sustains only as astigmatism as shown in Eq. (6)

$$\vec{H}(z_1) + \vec{H}(z_2) = \vec{H}_1(z_1) + \vec{H}_1(z_2) + 2\vec{H}_3(z_2)\cdot\vec{a}\cdot\vec{r} \quad (6)$$

The astigmatism of the electron beam is compensated for or corrected by the astigmatism caused by the distorted deflection field.

FIGS. 5A to 5D show the deformations of the magnetic field due to the insertions of semi-cylindrical magnetic piece pairs. It is apparent that the local magnetic field can be varied relatively freely in density and distribution depending upon the shapes and positions of the magnetic piece pair. In this case, law of similitude is held. That is, with the same flux the distortion of the field per unit length is in inverse proportion of the radius of the arm of the magnetic piece. This means that the distortion can be varied by varying the radius.

So far, the present invention has been described in conjunction with the deflection field which deflects the electron beam only in one direction. The reason is that with a laterally elongated screen such as those of television picture tubes, distortions of beam spots are mainly caused by distortions of horizontal deflection fields. However, distortions of beam spots due to the distortions of both the horizontal and vertical deflection fields must be taken into consideration in practice. FIGS. 6A to 6D show the field-control effects on the vertical deflection field due to the field-control element, FIGS. 6A to 6D corresponding to FIGS. 5A to 5D, respectively. That is, a magnetic piece pair which produces a pincushion-like-distorted field for a horizontal deflection field produces a barrel-like-distorted field for a vertical deflection field, and vice versa. When two magnetic pieces element pairs as shown in FIGS. 5A and 6A, 5B and 6B, 5C and 6C or 5D and 6D are disposed in tandem or series in, for instance, an in-line self-convergence type color picture tube in which the distortions of the horizontal and vertical deflection fields are opposite, such effects as described above are very advantageous in eliminating the distortions of the beam spots due to the distortions of the horizontal and vertical deflection fields.

Figure 7:
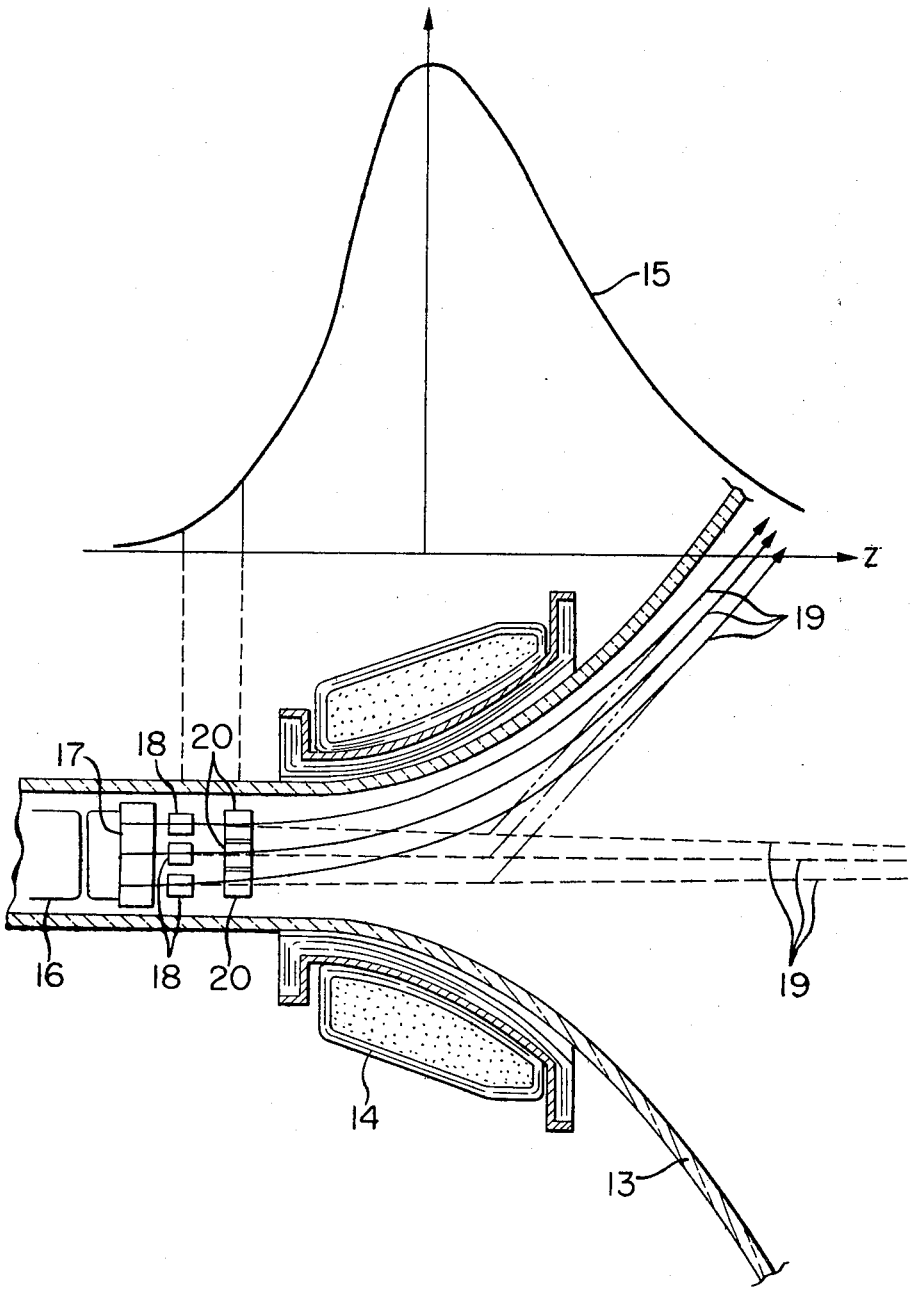
FIG. 7 is a perspective view of an in-line color picture tube to which is applied the present invention and also shows a deflection field strength curve.

In addition to the single electron gun, the present invention may be equally applied to the in-line guns in color picture tubes as shown in FIG. 7. A deflection yoke 14 is externally mounted over the merging portion between the funnel and neck of an envelope 13 and generates the deflection field the strength of which is indicated by a curve 15. The deflection field strength is extremely weak adjacent to the electron-beam emission end 17 of the in-line guns 16 and steeply rises as the electron beams approach toward a screen (not shown). The deflection distance is in proportion to a double integration of the field strength in the direction of the Z-axis so that the deflection distance in the vicinity of the electron-beam emission end 17 is very small. Therefore, three second field-control elements 18 each comprising a pair of semi-cylindrical magnetic pieces as described can be disposed for respective electron beams 19 whose paths are in the same horizontal plane in the vicinity of the electron-beam emission end 17 of the in-line guns 16. On the other hand, a first field-control element 20, which comprises a pair of semi-cylindrical magnetic pieces as described previously, must be disposed at the position at which the deflection field strength is relatively strong. Therefore, in order to balance the distortions of the local magnetic fields produced by the first and second field-control elements 20 and 18, the diameter of an effective aperture of the first field-control element 20 is made greater than that of an effective aperture of the second field-control element 18. In addition, the length of the first field-control element 20 in the direction of the Z-axis is made longer than that of the second field-control element 18.

In summary, disposed between the electron-beam emission end of the electron gun and the deflection yoke is a first magnetic-field-control element which comprises a pair of semi-cylindrical magnetic pieces disposed on the opposite sides of the path of the electron beam and which is adapted to produce or introduce a local magnetic-field distortion which is opposite to a magnetic-field distortion produced by the deflection yoke. In addition, disposed between the electron-beam emission end of the electron gun and the first field-control element is a second field-control element which comprises a pair of semi-cylindrical magnetic pieces disposed on the opposite sides, respectively, of the path of the electron beam and which is adapted to produce or introduce a local magnetic-field distortion which is opposite to a magnetic-field distortion produced or introduced by the first field-control element. Therefore, the first field-control element can eliminate the astigmatism caused by the distortion of the deflection field and the second field-control element can eliminate or compensate for the comma aberration caused by the first field-control element. The astigmatism caused by both the horizontal and vertical deflection fields can be eliminated by suitably selecting the configurations of the magnetic pieces of the first and second field-control elements. As a result, a higher degree of resolution is ensured at the edges of the screen.

What is claimed is:

1. An electromagnetic deflection type picture tube device characterized by the provision of (a) a first field-control element which is disposed between the electron-beam emission end of an electron gun and a deflection yoke, comprising a pair of magnetic pieces which are disposed on the opposite sides of the path of an electron beam, and being adapted to produce a local field distortion (a barrel or pincushion distortion) which is opposite to a main distortion (a pincushion or barrel distortion) of the deflection field by introducing the rise portion of the deflection field; and (b) a second field-control element which is disposed between the electron-beam emission end of the electron gun and said first field-control element, comprising a pair of magnetic pieces which are disposed on the opposite sides of the path of the electron beam, and being adapted to produce a local field distortion (a pincushion or barrel distortion) which is opposite to said local field distortion produced by said first field-control element by introducing the rise portion of said deflection field.

2. A cathode-ray tube device as set forth in claim 1 further characterized in that the effective diameter of said first field-control element is greater than that of said second field-control element, and the magnetic pieces of said first and second field-control elements are semi-cylindrical in shape.

* * * * *